US007878267B2

(12) United States Patent
Southard

(10) Patent No.: US 7,878,267 B2
(45) Date of Patent: Feb. 1, 2011

(54) ROTARY DIRECTIONAL DRILLING APPARATUS AND METHOD OF USE

(75) Inventor: Robert C. Southard, Houston, TX (US)

(73) Assignee: Southard Drilling Technologies, L.P., Houston, TX (US)

( * ) Notice: Subject to any disclaimer, the term of this patent is extended or adjusted under 35 U.S.C. 154(b) by 0 days.

(21) Appl. No.: 12/291,443

(22) Filed: Nov. 10, 2008

(65) Prior Publication Data

US 2010/0116551 A1 May 13, 2010

(51) Int. Cl.
*E21B 7/04* (2006.01)

(52) U.S. Cl. ..... 175/45

(58) Field of Classification Search ..... 175/107, 175/60, 61, 73, 325.3, 76
See application file for complete search history.

(56) References Cited

U.S. PATENT DOCUMENTS 5,706,905 A 1/1998 Barr
5,778,992 A * 7/1998 Fuller ..... 175/73
6,209,664 B1 4/2001 Chaffaut
6,394,193 B1 5/2002 Askew
7,188,685 B2 3/2007 Downton
2006/0243493 A1 * 11/2006 El-Rayes et al. ..... 175/107
2009/0095528 A1 * 4/2009 Hay et al. ..... 175/26

* cited by examiner

*Primary Examiner*—Kenneth Thompson
*Assistant Examiner*—James G. Sayre
(74) *Attorney, Agent, or Firm*—The Matthews Firm

(57) ABSTRACT

An apparatus for steering a drill string is disclosed herein, the apparatus comprising a drilling motor comprising a rotor, a stator, and at least one fluid passage for flowing drilling fluid to the stator. A blade is fixedly disposed on the exterior surface of the stator. A diverter valve controls the flow rate of drilling fluid to the stator, to provide counter rotational movement to the stator with respect to the rotor. Placement and movement of the blade is thereby controlled. When the blade is rotated such that it remains stationary with respect to a fixed point in a borehole, the drill bit is turned. When the blade is counter-rotated in a constant motion with respect to the rotor, the drill bit continues to drill in a straight direction.

20 Claims, 3 Drawing Sheets

ROTARY DIRECTIONAL DRILLING APPARATUS AND METHOD OF USE

FIELD

The embodiments herein relate generally to rotary directional drilling apparatuses for downhole steering of a drill bit and methods for steering a drill string.

BACKGROUND

During rotary drilling, a drill bit is rotated from the surface of a well by rotating a drill string. It is often desirable to control the direction in which the drilling proceeds through use of a downhole steerable drilling apparatus. Steerable drilling apparatuses include hydraulic devices that apply a lateral bias to a drill string, bent or bendable housing members for drilling at angles, and rotary devices that use a rotatable member, actuators, and/or retractable members to control the direction of the drill string.

Conventional downhole rotary directional drilling assemblies use gravity and compression to force an under gauge stabilizer to the bottom side of a hole, with a drill collar acting as a lever, and a near bit stabilizer acting as a fulcrum. This lever-like motion pushes the drill bit upward, causing the drill bit to drill on the top of a hole, thereby increasing the angle of the hole. The angle of the drilling can be modified through changes in the length of the drill collar, the diameter of the stabilizers, or modifying one or more drilling parameters.

Conventional rotary directional drilling assemblies can steer a drill bit only within a single plane, and not along the azimuth.

A need exists for a rotary directional drilling apparatus that can allow an operator to steer a drill string in any direction, controlling directional changes both in hole angle and along the azimuth.

A need also exists for a rotary directional drilling apparatus that can utilize fixed steering elements without use of actuators, rather than conventional retractable and movable biasing and thrusting members.

A further need exists for a rotary directional drilling apparatus able to selectively adjust the orientation of a drill bit through control of the flow of drilling fluid or mud through the mud motor.

The present embodiments meet these needs.

SUMMARY

In an embodiment, the present apparatus for steering a drilling string includes a downhole drilling motor having a rotor for imparting rotational movement to the drill bit, and a stator rotatably disposed about the rotor. The stator can be freely rotatable about the rotor, enabling counter rotation of the stator relative to the rotor. One or more bearings, rollers, and/or seals, as known in the art, can be disposed between the rotor and the stator to enable this rotation.

It should be noted that the drill string is connected to the rotor, rather than to the stator, while conventional rotary directional drilling assemblies typically utilize a connection between the drill string and the stator. Rotation of the drill string, such as when drilling, as known in the art, thereby imparts rotation to the rotor without imparting this rotation to the stator. Various bearings, rollers, and/or seals, as known in the art, can be disposed at each end of the motor to facilitate this rotation and prevent the loss of drilling fluid from the stator, In an embodiment, the drill string can have a concentric stabilizer connected thereon.

A first passage is disposed through the rotor for flowing drilling fluid through the rotor to the drill bit. One or more fluid passages are disposed through the rotor to flow drilling fluid between the first passage and the stator. The stator can include a fluid passage having vanes, lobes, or similar protrusions, as known in the art, adapted to enable the flow of fluid to impart rotational motion to the stator in a direction counter to the rotation of the rotor imparted by the drill string. The flow rate of drilling fluid or mud to the stator controls the rate of rotation of the stator. In an embodiment, the rotor can include an upper diverter passage disposed through a first end of the rotor and a lower diverter passage disposed through a second end of the rotor.

In a further embodiment, the first passage can include a flow restrictor for facilitating the flow of drilling fluid to at least one of the fluid passages to cause counter rotation of the stator relative to the rotor.

One or more seals can be disposed between the rotor and the stator, exterior to each of the fluid passages.

A valve is disposed in communication with the first passage and one of the fluid passages to the stator for selectively controlling the flow of drilling fluid between the first passage and the stator. The flow rate of drilling fluid conveyed to the stator can be controlled by the valve, thereby controlling the rotational speed of the stator.

In an embodiment, the valve can be in communication with a measurement while drilling device and can be controlled responsive to data from the measurement while drilling device. In a further embodiment, the valve can include an actuator, a power supply, or combinations thereof.

One or more blades can be fixedly disposed on the exterior surface of the stator. The one or more blades are usable to orient the drill bit and steer the drill string by providing an asymmetrical moment to the drill string. By selectively controlling the rate of counter rotation of the stator relative to the rotor, the direction of drilling operations can be controlled. The stator can be counter rotated at an equal rate with respect to the rotation of the rotor to maintain the one or more blades in a stationary orientation with respect to a fixed position within a borehole. The one or more blades thereby offset the apparatus' rotational center from the center of the borehole by providing the apparatus with an asymmetrical moment, thereby enabling reorientation of the drill bit in any horizontal or vertical direction through selective positioning of the blades. In an embodiment, the one or more blades can be over-gauge blades.

The blades are also usable to maintain the orientation of the drill bit and continue drilling in a straight direction by selectively controlling the flow rate of drilling fluid through the stator to maintain constant rotation of the one or more blades with respect to the rotor.

In an embodiment, the apparatus can include an electronic member in communication with the measurement while drilling device and with the valve for determining the current position of the one or more blades and controlling the valve in response to data obtained from the measurement while drilling device.

The present embodiments also relate to methods for steering a drill string using similar rotatable asymmetrical moments about a drill string. In an embodiment, a rotary directional drilling assembly, which can include a motor, valve, and blade, as described previously, is provided, coupled with a measurement while drilling device in communication with a drill string.

Data from the measurement while drilling device is received, and a position of the blade necessary to orient the drill bit in a desired direction is determined. The current location of the blade can be determined using the measurement while drilling device.

The valve is then controlled to achieve the necessary flow of drilling fluid to the stator, to cause counter rotation of the stator relative to the rotor until the desired position of the blade is reached. The valve can then be adjusted to change the rotational speed of the stator to maintain the blade in the desired position with respect to the borehole. The position of the blade causes reorientation of the drill bit. The valve can then be readjusted to change the rotational speed of the stator to cause drilling to continue in a generally straight direction.

The valve can be controlled to enable fluid flow to the stator such that the blade remains stationary with respect to a fixed point within the bore hole, thereby causing the drill string to change direction through reorientation of the drill bit. Alternatively, the valve can be controlled to regulate the flow of drilling fluid to the stator such that the stator continuously rotates relative to the rotor, thereby causing the drill string to drill in a constant direction.

The present embodiments thereby enable steering of a drill string through control of a rotatably moveable asymmetrical moment about a drill string, which can be rotated about the drill string through selective control of the flow of drilling fluid.

BRIEF DESCRIPTION OF THE DRAWINGS

In the detailed description of the embodiments presented below, reference is made to the accompanying drawings, in which.

The present embodiments are detailed below with reference to the listed Figures.

DETAILED DESCRIPTION OF THE EMBODIMENTS

Before explaining the present embodiments in detail, it is to be understood that the embodiments are not limited to the particular descriptions and that the embodiments can be practiced or carried out in various ways.

Figure 1:
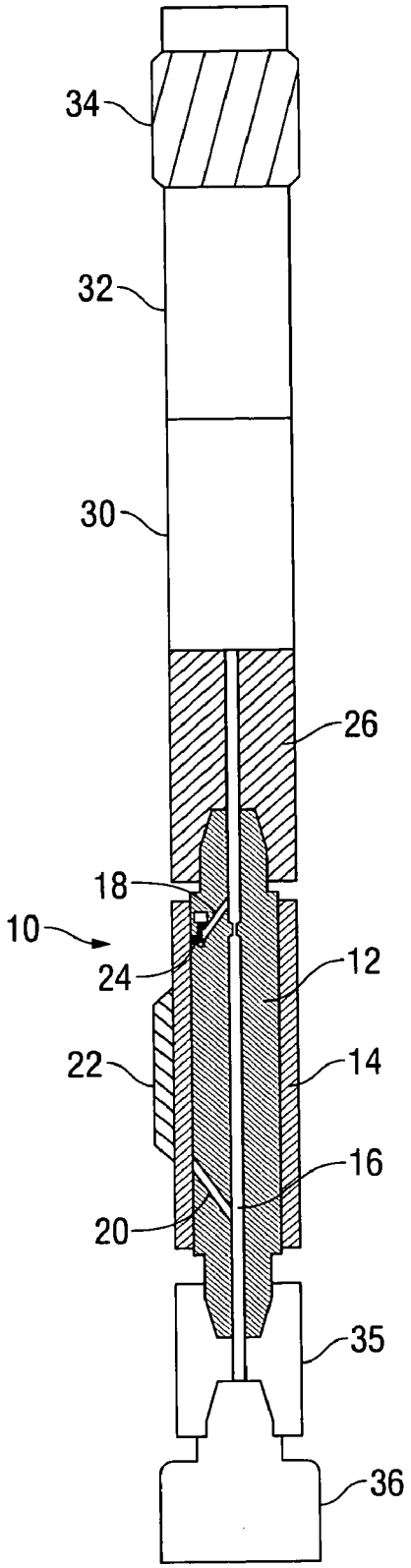
FIG. 1 depicts a cross-sectional view of an embodiment of the present rotary directional drilling apparatus attached to a drill string.

Referring now to FIG. 1, a cross-sectional view of an embodiment of the present rotary directional drilling apparatus is depicted, usable to orient a drill bit (36) for steering a drill string (32).

The apparatus is shown having a downhole motor (10), which includes a rotor (12) and a stator (14). A passage (16) is shown extending through the rotor (12), which is depicted extending along the central axis of the rotor (12).

An upper diverter passage (18) and a lower diverter passage (20) are shown extending through the rotor (12) between the passage (16) and the stator (14). A blade (22), which in an embodiment, can include an over-gauge blade, is shown disposed on the exterior surface of the stator (14). The blade (22) offsets the apparatus' rotational center from the center of a borehole, thereby enabling reorientation of the drill bit (36) through selective placement of the blade (22).

The stator (14) is freely rotatable about the rotor (12), such that the blade (22) can be selectively maintained in a stationary position with respect to a bore hole, to reorient the drill bit (36), or selectively maintained in constant counter rotational motion with respect to the rotor (12), to maintain a straight drilling direction. One or more bearings, rollers, or similar devices, as known in the art, can be used to enable the stator (14) to rotate independent of the rotor (12). Due to the ability of the blade (22) to be positioned on any side of the drill string (32) through rotation of the stator (14), the blade (22) is usable to orient the drill bit (36) in any horizontal or vertical direction.

A valve (24) is shown disposed within the upper diverter passage (18) of the rotor (12), in communication with the passage (16). A sub (26), shown connected to the rotor (12), can contain electronic controls and/or a power supply for the valve (24) and/or a measurement while drilling device, or other similar devices in communication with the drill string (32).

The valve (24) is controllable to regulate the flow of drilling fluid from the passage (16), through the upper diverter passage (18), to a stator passage (25, shown in FIG. 2) disposed in the stator (14). The stator passage can include one or more interior vanes (14A) (e.,g., lobes or similar protrusions), as known in the art, such that the flow of drilling fluid through the stator passage imparts rotation to the stator (14) as fluid impacts one or more of the vanes (14A). The flow rate of drilling fluid to the stator (14) controls the rate of counter rotation of the stator (14) with respect to the rotor (12).

FIG. 1 also depicts a measurement while drilling device (30) attached to the sub (26). The drill string (32) is depicted attached to the measurement while drilling device (30). A concentric stabilizer (34) is depicted attached to the drill string (32). Data from the measurement while drilling device (30) is usable to control the valve (24) for positioning of the blade (22) to reorient the drill bit (36).

It should be noted that the drill string (32) is attached to the rotor (12), via the measurement while drilling device (30) and the sub (26), rather than to the stator (14), while a conventional rotary directional drilling apparatus utilizes a connection between the drill string and the stator. The rotor (12) is also shown attached to a near-bit stabilizer (35), which is in turn attached to the drill hit (36). In an embodiment, the near-bit stabilizer (35) can include a reamer. Bearings andior rollers, as are known in the art, can be disposed at each end of the rotor (12) to facilitate rotation of the rotor (12). Bearings and/or seals, as known in the art, can be disposed at each end of the stator (14) to facilitate rotation of the stator (14) and prevent the exodus of drilling fluid from the stator passage into the annulus.

Figure 2:
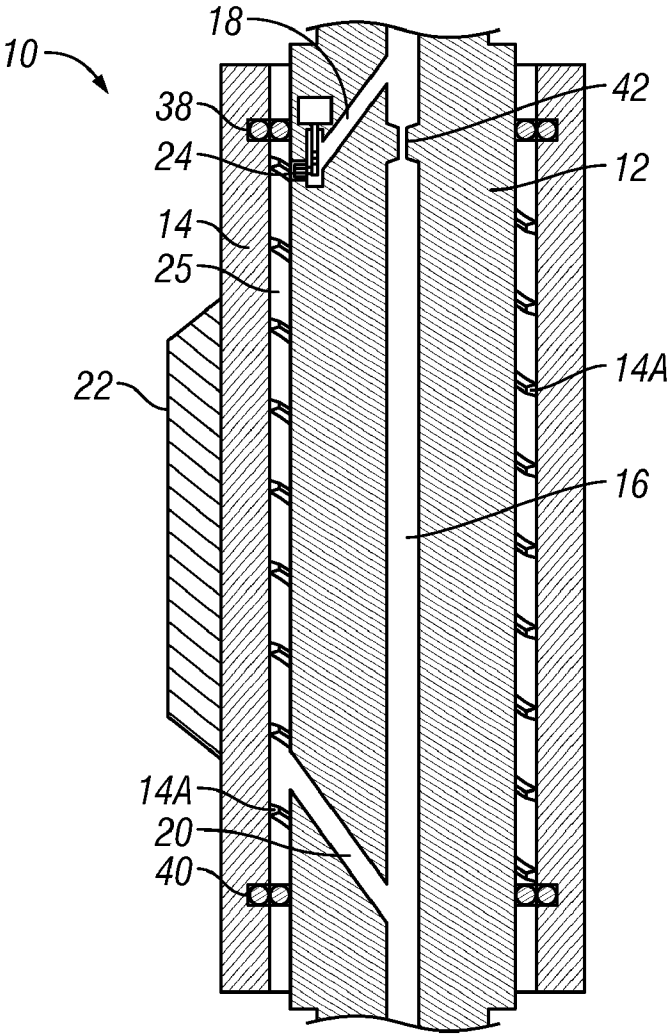
FIG. 2 depicts a cross sectional view of an embodiment of the motor of the rotary directional drilling apparatus of FIG. 1.

Referring now to FIG. 2, a cross-sectional view of the downhole motor (10) is shown.

The stator (14), having the blade (22) disposed thereon, is shown rotatably disposed about the rotor (12). Bearings and/or rollers, as known in the art, can be disposed between the rotor (12) and the stator (14) to facilitate rotation of the stator (14). The passage (16) is shown in communication with the upper diverter passage (18) and lower diverter passage (20) for conveying drilling fluid to and from a stator passage (25) within the stator (14). The stator passage (25) can include various vanes (14A) (and/or other similar protrusions) adapted to enable rotation of the stator (14) as drilling fluid is flowed through the stator passage (25). The valve (24) is shown disposed within the upper diverter passage (18) in communication with the passage (16), for controlling the flow of drilling fluid from the passage (16) through the upper diverter passage (18) to the stator (14), thereby controlling the rotational speed of the stator (14) relative to the rotor (12).

An upper seal (38) is shown disposed between the rotor (12) and the stator (14) above the upper diverter passage (18). A lower seal (40) is shown disposed between the rotor (12) and the stator (14) below the lower diverter passage (20).

FIG. 2 also depicts a flow restriction (42) within the passage (16), which facilitates the flow of drilling fluid to the upper diverter passage (18) via the valve (24), while allowing excess fluid to flow through the passage (16) to the drill bit.

Figure 3:
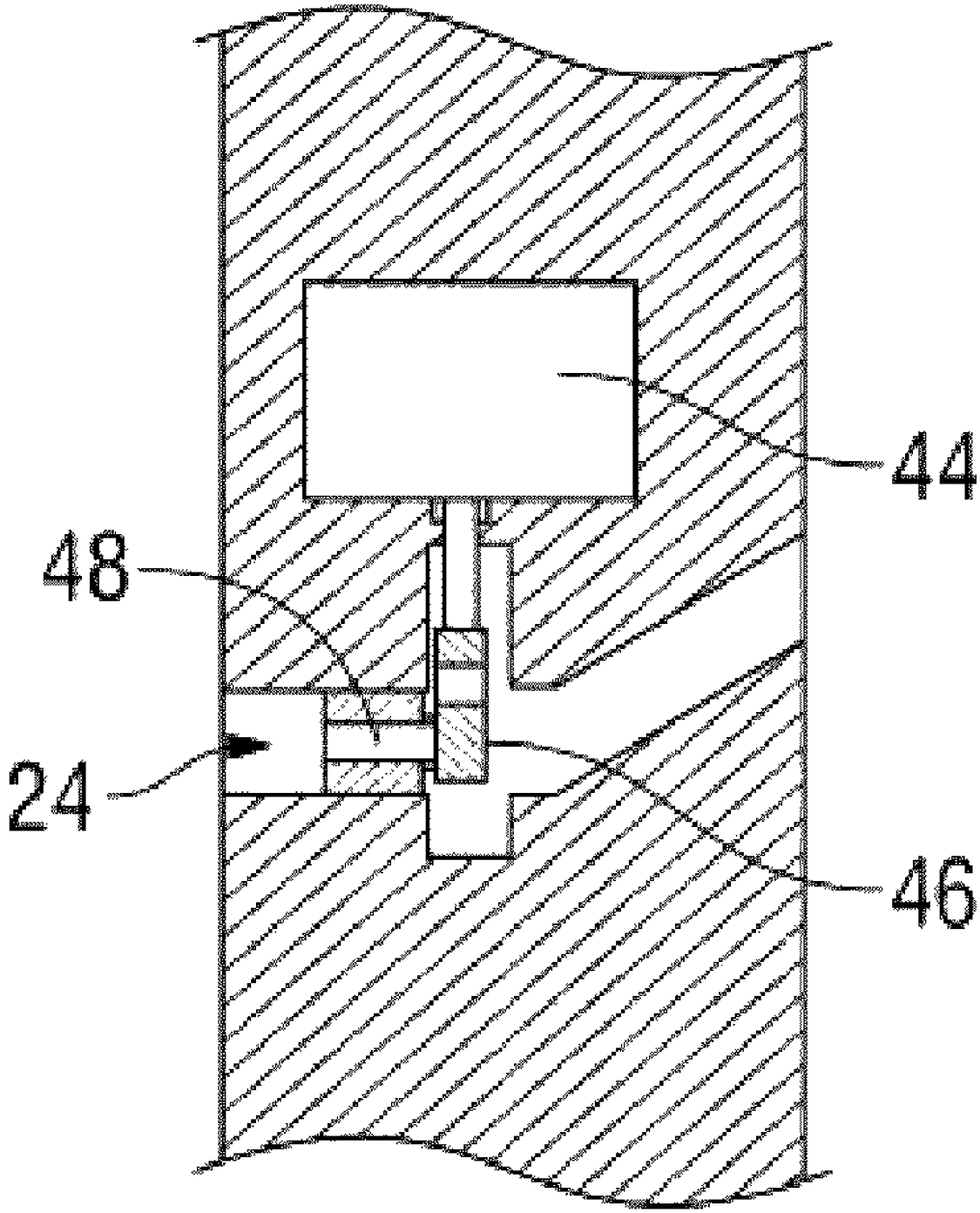
FIG. 3 depicts a cross sectional view of the diverter valve of the rotary directional drilling apparatus of FIG. 1.

Referring now to FIG. 3, a cross-sectional view of the valve (24) is depicted.

FIG. 3 depicts an actuator and power supply (44) usable to actuate a movable member (46) until partially or fully aligned with the valve passage (48). While the actuator and power supply (44) are depicted in close proximity to the valve (24), in an embodiment, the actuator and power supply could be remote from the motor, such as disposed within an adjacent sub. Through selective actuation of the valve (24), the flow rate of drilling fluid to the stator can be controlled to achieve a desired rate of counter rotation of the stator relative to the rotor.

The present rotary directional drilling apparatus is thereby able to use the flow rate of drilling mud to selectively position an exterior blade with respect to a bore hole to orient the direction of a drill bit, without use of thrusting, actuatable, or retractable steering members, by enabling counter rotation of the stator and blade relative to the rotor.

Figure 4A:
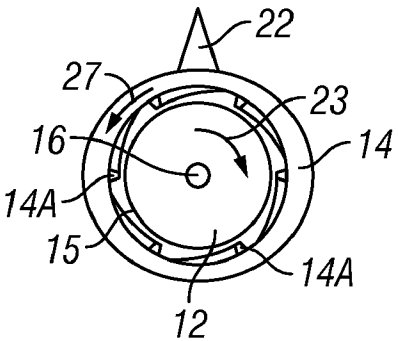
FIGS. 4A and 4B depict an end view of an embodiment of the present rotary directional drilling appratus showing the rotation of the rotor and the stator.
Figure 4B:
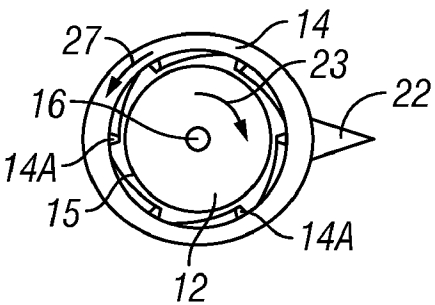

FIGS. 4A and 4B depict end views of the rotor (12) having the fluid passage (16) extending therethrough, with the stator (14) rotatably disposed about the rotor (12). FIG. 4A depicts the blade (22) disposed on the exterior surface of the stator (14) in a first position, while FIG. 4B depicts the blade (22) in a second position rotationally displaced from the first position. A bearing surface (15), which can include various bearings and/or rollers as known in the art, can be disposed between the rotor (12) and stator (14) to facilitate the rotation of the stator (14) relative to the rotor (12). As a drill string connected to the rotor (12) is rotated, such as when drilling, rotation is imparted to the rotor (12) in a first direction (23). Selectively, fluid that flows through the fluid passage (16) to the drill bit can be diverted through diverter passages (shown in FIGS. 1 and 2) to a stator passage (25) disposed within the stator (14), which can include vanes (14A) (or similar protrusions) adapted to provide counter rotation to the stator (14) in a second direction (27) opposite the first direction (23). The blade (22) disposed on the exterior of the stator (14) can thereby be rotated to any position about the drill string, as illustrated.

What is claimed:

1. An apparatus for steering a drill string, the apparatus comprising:

a drilling motor comprising a rotor, a stator, a first passage disposed through the rotor for flowing drilling fluid from the rotor to a drill bit, and at least one fluid passage communicating between the first passage and a stator fluid passage between the rotor and the stator, wherein said at least one fluid passage is disposed through the rotor for flowing drilling fluid between the first passage and the stator fluid passage, and wherein the stator is rotatably disposed at least partially concentrically about the rotor, and wherein the stator is configured for counter rotation relative to the rotor in response to fluid flow through the stator fluid passage;

a valve in communication with the first passage for selectively controlling the flow of drilling fluid from the first passage to the stator, wherein the rotation of the stator is controllable by the flow of drilling fluid to the stator; and at least one blade fixedly disposed on an exterior surface of the stator, wherein rotation of the stator controls placement of said at least one blade to provide an asymmetrical moment to the drill string and achieve a desired orientation of the drill bit for steering the drill string.

2. The apparatus of claim 1, wherein the drill string is connected to the rotor.

3. The apparatus of claim 2, wherein the drill string is further in communication with a concentric stabilizer.

4. The apparatus of claim 1, wherein the valve is in communication with a measurement while drilling device, and wherein the valve is controllable responsive to data from the measurement while drilling device.

5. The apparatus of claim 4, further comprising an electronic member in communication with the measurement while drilling device and with the valve for locating the position of said at least one blade and controlling the valve using data from the measurement while drilling device.

6. The apparatus of claim 1, wherein the valve comprises an actuator, a power supply, or combinations thereof.

7. The apparatus of claim 1, further comprising at least one seal between the rotor and the stator, wherein said at least one seal is exterior to said at least one fluid passage.

8. The apparatus of claim 1, wherein the first passage comprises a flow restrictor for facilitating the flow of drilling fluid to said at least one fluid passage to cause rotation of the stator relative to the rotor.

9. The apparatus of claim 1, wherein said blade is an over-gauge blade.

10. A method for steering a drill string, the method comprising the steps of:

providing a rotary directional drilling assembly comprising:

a measurement while drilling device in communication with the drill string;

a motor comprising a rotor, a stator, a first passage disposed through the rotor for flowing drilling fluid from the rotor to a drill bit, and at least one fluid passage in communication with the first passage and a stator fluid passage between the rotor and the stator for flowing drilling fluid between the first passage and the stator fluid passage, wherein the stator is rotatably disposed about the rotor for, and wherein the stator is configured for counter rotation relative to the rotor;

a valve in communication with the first passage for selectively controlling the flow of drilling fluid through first passage to the stator fluid passage, wherein the valve is controllable responsive to data from the measurement while drilling device, and wherein the counter rotation of the stator is controllable by the flow of drilling fluid to the stator fluid passage; and at least one blade fixedly disposed on an exterior surface of the stator, wherein placement of said at least one blade is controllable through rotation of the stator;

receiving data from the measurement while drilling device on a desired orientation of the drill bit for steering the drill string;

determining a position of said at least one blade necessary to achieve the desired orientation of the drill bit; and controlling the valve to regulate the flow of drilling fluid from the first passage to the stator fluid passage, wherein the drilling fluid causes counter rotation of the stator relative to the rotor, until the position of said at least one blade is reached for orienting the drill bit in the desired orientation.

11. The method of claim 10, wherein the step of determining the position of said at least one blade necessary to achieve the desired direction comprises determining a current position of said at least one blade using the measurement while drilling device.

12. The method of claim 10, further comprising the step of controlling the valve to regulate the flow of drilling fluid to the stator such that the position of said at least one blade remains stationary with respect to a fixed point within a bore hole, thereby causing the drill bit to change orientation.

13. The method of claim 10, further comprising the step of controlling the valve to regulate the flow of drilling fluid through the stator such that the stator continuously rotates relative to the rotor, thereby causing the drill string to drill in a constant direction.

14. A rotary directional drilling assembly for steering a drill string, the assembly comprising:

a measurement while drilling device in communication with the drill string;

a motor comprising:

a rotor with a central passage disposed therethrough for flowing drilling fluid from the rotor to a drill bit;

a stator rotatably disposed at least partially concentrically about the rotor, wherein the stator is configured for counter rotation relative to the rotor, and wherein the stator comprises at least one blade disposed on an exterior surface;

an upper diverter passage disposed at a first end of the motor extending between the central passage and a stator fluid passage between the rotor and the stator for flowing drilling fluid from the central passage to the stator fluid passage; and a lower diverter passage disposed at a second end of the motor extending between the central passage and the stator fluid passage for flowing drilling fluid from the stator fluid passage to the central passage; and a valve in communication with the central passage for selectively controlling the flow of drilling fluid from the central passage through the upper diverter passage to the stator fluid passage, wherein the valve controls the flow of drilling fluid to the stator fluid passage in response to data from the measurement while drilling device, and wherein counter rotation of the stator is controllable by the conveyance of drilling fluid through the stator fluid passage, thereby controlling placement of said at least one blade to achieve a desired orientation of the drill bit for steering the drill string.

15. The apparatus of claim 14, wherein the drill string is connected to the rotor via the at least one sub containing the measurement while drilling device.

16. The apparatus of claim 14, wherein the drill string is further in communication with a concentric stabilizer.

17. The apparatus of claim 14, further comprising an electronic member in communication with the measurement while drilling device and with the valve for locating the position of said at least one blade and controlling the valve using data from the measurement while drilling device.

18. The apparatus of claim 14, wherein the valve comprises an actuator, a power supply, or combinations thereof

19. The apparatus of claim 14, further comprising a first seal between the rotor and the stator above the upper diverter passage, and a second seal between the rotor and the stator below the lower diverter passage.

20. The apparatus of claim 14, wherein the central passage comprises a flow restrictor for facilitating the flow of drilling fluid to the upper diverter passage to cause counter rotation of the stator relative to the rotor.

* * * * *